US009649850B2

(12) United States Patent
Xing et al.

(10) Patent No.: US 9,649,850 B2
(45) Date of Patent: May 16, 2017

(54) INK JETTING DIGITAL PRINTING APPARATUS AND METHOD SUPPORTING DOUBLE-SIDE PRINTING

(71) Applicants: Peking University Founder Group Co., Ltd., Beijing (CN); Founder Information Industry Holdings Co., Ltd., Beijing (CN); Beijing Founder Electronics Co., Ltd., Beijing (CN)

(72) Inventors: Xiaoxiao Xing, Beijing (CN); Xingxin Sun, Beijing (CN); Weiping Huang, Beijing (CN)

(73) Assignees: PEKING UNIVERSITY FOUNDER GROUP CO., LTD., Beijing (CN); FOUNDER INFORMATION INDUSTRY HOLDINGS CO., LTD., Beijing (CN); BEIJING FOUNDER ELECTRONICS CO., LTD., Beijing (CN)

( * ) Notice: Subject to any disclaimer, the term of this patent is extended or adjusted under 35 U.S.C. 154(b) by 0 days.

(21) Appl. No.: 14/908,720

(22) PCT Filed: Nov. 8, 2013

(86) PCT No.: PCT/CN2013/086752

§ 371 (c)(1),
(2) Date: Jan. 29, 2016

(87) PCT Pub. No.: WO2015/014039

PCT Pub. Date: Feb. 5, 2015

(65) Prior Publication Data

US 2016/0214394 A1 Jul. 28, 2016

(30) Foreign Application Priority Data

Jul. 31, 2013 (CN) ..... 2013 1 0329788

(51) Int. Cl.
*B41J 2/21* (2006.01)
*B41J 3/60* (2006.01)

(52) U.S. Cl.
CPC ..... *B41J 2/2103* (2013.01); *B41J 3/60* (2013.01)

(58) Field of Classification Search
CPC ..... B41J 2/2103
See application file for complete search history.

(56) References Cited

U.S. PATENT DOCUMENTS 6,476,923 B1 * 11/2002 Cornell ..... B41J 3/54 358/1.12

FOREIGN PATENT DOCUMENTS

CN 102529405 A 7/2012
CN 103129161 A 6/2013
(Continued)

*Primary Examiner* — Jason Uhlenhake
(74) *Attorney, Agent, or Firm* — Brinks Gilson & Lione

(57) ABSTRACT

An ink jetting digital printing apparatus supporting double-side printing is provided. The ink jetting digital printing apparatus comprises: a first sprayer module and a corresponding first group of color plane control servers, a second sprayer module and a corresponding second group of color plane control servers, a rasterization image processing server, and a system control server. The first and second sprayer modules comprise a group of sprayers of the same two or more colors; the first group comprises color plane control servers in one-to-one correspondence with sprayers in the first sprayer module; the second group comprises color plane control servers in one-to-one correspondence with sprayers in the second sprayer module; the first group color plane control servers parallel with the second group color plane control servers.

7 Claims, 8 Drawing Sheets

(56) References Cited

FOREIGN PATENT DOCUMENTS

| | | | |
|---|---|---|---|
| CN | 103182863 | A | 7/2013 |
| JP | 2011143613 | A | 7/2011 |
| JP | 2011143613 | A2 * | 7/2011 |
| JP | 2012183696 | A | 9/2012 |

* cited by examiner

INK JETTING DIGITAL PRINTING APPARATUS AND METHOD SUPPORTING DOUBLE-SIDE PRINTING

CROSS-REFERENCE TO RELATED APPLICATIONS

This application is a national application of PCT/CN2013/086752, filed on Nov. 8, 2013, which application claims a right of priority to Chinese Patent Application No. 201310329788.6, filed Jan. 31, 2013, both of which are incorporated herein by reference in their entirety.

FIELD OF THE INVENTION

This invention relates to the field of digital print technology, and particularly relates to an ink jetting digital printing apparatus and method supporting double-side printing.

DESCRIPTION OF THE RELATED ART

Ink jetting digital print is a print technology advanced rapidly in recent years, in which data is transmitted directly for processing and printing, i.e., with a single input process of imaging data, a control system controls an imaging member to produce an image directly. With respect to regular digital printing apparatus performing on-demand ink jetting digital print, under the control of the control system, in the imaging member, when a surface of a carrier medium (such as a sheet of paper) reaches a predetermined position, piezoelectric crystals in nozzles generate pulses to extrude ink and directly spray ink drops in a mist form on the surface of the carrier medium (such as a sheet of paper) so as to produce an image.

In the digital print technology, first of all, a RIP (Raster Image Processor) performs a rasterization process on a file to be printed, for example, a PostScript (a page description language) file or a PDF (Portable Document Format) file, to produce rasterization pixels that can be printed with sprayers. In color digital printers, it is also required for rasterization software to calculate rasterization pixels for different color planes and then transmits these rasterization pixels to color plane control modules of various color planes to perform printing of each color plane. Every page of the file to be printed must be rasterized to produce corresponding print pixels.

A main problem faced by the digital print technology is the continuously increased print speed. There are many factors that restrict print speed of digital printers, including processing speed of rasterization software, data transmission rate between control modules, the speed of reading data from a hard disk, and calculation speeds of control modules. Therefore, a solution of parallel calculation using multiple channels has been proposed to increase RIP processing speed.

In the prior art, high-speed ink jetting digital printers usually adopt a distributed architecture to resolve the problem of high speed transmission of print data. With the popularization of the digital print technology in practical applications, it is desired to meet demands of various print modes, for example, one-side printing and double-side printing. Different print modes have different requirements for the processing of print data. In the case of color one-side printing, there is a well-established function flow; however, the existing distributed structure does not support color double-side printing.

The information disclosed in this related art section should not be taken as an acknowledgement or any form of suggestion that this information forms the prior art that is already known to a person skilled in the art or is common knowledge in the art before the filing date or priority date of any claims of this application.

SUMMARY OF THE INVENTION

An ink jetting digital printing apparatus and method supporting double-side printing is provided in this invention to achieve the function of double-side color printing with a distributed architecture, so as to increase print speed.

Therefore, the following solution is provided in embodiments of this invention.

An ink jetting digital printing apparatus supporting double-side printing, comprising: a first sprayer module and a corresponding first group of color plane control servers, a second sprayer module and a corresponding second group of color plane control servers, a rasterization image processing server, and a system control server; wherein the first sprayer module and the second sprayer module comprise a group of sprayers of the same two or more colors respectively; the first group of color plane control servers comprise color plane control servers in one-to-one correspondence with sprayers in the first sprayer module; the second group of color plane control servers comprise color plane control servers in one-to-one correspondence with sprayers in the second sprayer module; the color plane control servers in the first group of color plane control servers are arranged in parallel with the color plane control servers in the second group of color plane control servers;

the rasterization image processing server is used to perform a rasterization process on a print file of a current print job, and transmit page data obtained after the process to a corresponding group of color plane control servers;

the first group of color plane control servers are used to generate complete font-side print data according to the page data received from the rasterization image processing server, and transmit the font-side print data to a corresponding first hardware control module;

the first hardware control module is used to control the first sprayer module according to the complete font-side print data to complete the printing of the font-side print data;

the second group of color plane control servers are used to generate complete back-side print data according to the page data received from the rasterization image processing server, and transmit the back-side print data to a corresponding second hardware control module; and the second hardware control module is used to control the second sprayer module according to the complete back-side print data to complete the printing of the back-side print data.

Preferably, the rasterization image processing server comprises:

a data obtaining unit for obtaining print data of the print file;

a data processing unit for performing a rasterization process on the print data to obtain page data;

a page determination unit for determining whether a page the page data belongs to is a odd page or an even page; and a data transmission unit for transmitting page data of an odd page determined by the page determination unit to various color plane control servers of the first group of color plane control servers, and transmitting page data of an even page determined by the page determination unit to various color plane control servers of the second group of color plane control servers.

Preferably, various color plane control servers of the first group of color plane control servers and various color plane control servers of the second group of color plane control servers are further used to transmit print progress information to a system control server; and the system control server is used to, according to the print progress information of the various color plane control servers, calculate a number of pages that have been printed in the current print job and display the page number information on a user interface.

Preferably, the system control server is further used to, when it is required to browse a print job, according to whether a page to be browsed is an odd or even page, send a command to the first group of color plane control servers or the second group of color plane control servers to instruct the group of color plane control servers to return print data of the specified page;

the first group of color plane control servers and the second group of color plane control servers are further used to, after receiving the command sent from the system control server, return print data of the specified page to the system control server respectively; and the system control server is further used to, after receiving the print data returned from the group of color plane control servers, convert the print data to an image and display the image on the user interface.

An ink jetting digital printing method supporting double-side printing comprises the following steps:

A. a rasterization image processing server performs a rasterization process on a print file of a current print job, and transmits page data obtained after the process to various color plane control servers of a corresponding group of color plane control servers;

B. the group of color plane control servers generates complete print data according to the page data received from the rasterization image processing server and storing the print data locally;

C. during a print process, various color plane control servers of the group of color plane control servers control corresponding sprayers according to print data stored locally to complete the print job.

Preferably, the group of color plane control servers comprise a first group of color plane control servers and a second group of color plane control servers, various color plane control servers of one group of color plane control servers being arranged in parallel with color plane control servers of the other group of color plane control servers.

Preferably, step A comprises:

performing a rasterization process on the print file of the current print job by the rasterization image processing server to obtain the page data;

determining whether the page data belongs to an odd page or an even page;

in the case of an odd page, transmitting the page data to various color plane control servers of the first group of color plane control servers; and in the case of an even page, transmitting the page data to various color plane control servers of the second group of color plane control servers.

Preferably, the method further comprises:

during the printing process, transmitting, by various color plane control servers of the group of color plane control servers, print progress information to a system control server during a print process; and according to the print progress information received from the various color plane control servers, calculating by the system control server a number of pages that have been printed in the current print job and displaying the page number information on a user interface.

Preferably, the method further comprises:

when it is required to browse the print job, according to whether a page to be browsed is an odd or even page, sending by the system control server a command to the first group of color plane control servers or the second group of color plane control servers to instruct the group of color plane control servers to return print data of the specified page;

after receiving the command sent from the system control server, returning print data of the specified page to the system control server by the first group of color plane control servers and the second group of color plane control servers respectively; and after receiving the print data returned from the group of color plane control servers, converting the print data to an image by the system control server and displaying the image on the user interface.

Preferably, according to whether a page to be browsed is an odd or even page, sending by the system control server a command to the first group of color plane control servers or the second group of color plane control servers to instruct the group of color plane control servers to return print data of the specified page comprises:

if page n to be browsed is an odd page, sending by the system control server a command to the first group of color plane control servers to instruct the first group of color plane control servers to return print data of the page (n+1)/2; and if page n to be browsed is an even page, sending by the system control server a command to the second group of color plane control servers to instruct the second group of color plane control servers to return print data of the page n/2.

In the ink jetting digital printing apparatus and method supporting double-side printing provided in this invention, two groups of color plane control servers arranged in parallel with each other are used to control a sprayer module for printing front-side print data and a sprayer module for printing back-side print data; the rasterization image processing server performs a rasterization process on a print file of a current print job and transmits page data obtained after the process to various color plane control servers of a corresponding group of color plane control servers, instead of various color plane control servers of all groups of color plane control servers, so that the function of supporting double-side color printing with a distributed architecture is realized, and print speed is increased.

DESCRIPTION OF THE EMBODIMENTS

Below, various exemplary embodiments of the present invention will now be described in detail with reference to the drawings.

It should be noted that the relative arrangement of the components and steps, the numerical expressions, and numerical values set forth in these embodiments do not limit the scope of the present invention unless it is specifically stated otherwise.

Meanwhile, it should be appreciated that, for the convenience of description, various parts in the accompanying drawings are not necessarily drawn to practical scale.

The following description of at least one exemplary embodiment is merely illustrative in nature and is in no way intended to limit the invention, its application, or uses.

Techniques, methods and apparatus as known by one of ordinary skill in the relevant art may not be discussed in detail but are intended to be part of the specification where appropriate.

In all of the examples illustrated and discussed herein, any specific values should be interpreted to be illustrative only and non-limiting. Thus, other examples of the exemplary embodiments could have different values.

To enable those skilled in the art to better understand the solution of embodiments of the present invention, a brief introduction of the structure and operation principle of an ink jetting digital printer in the prior art will be given below.

Figure 1:
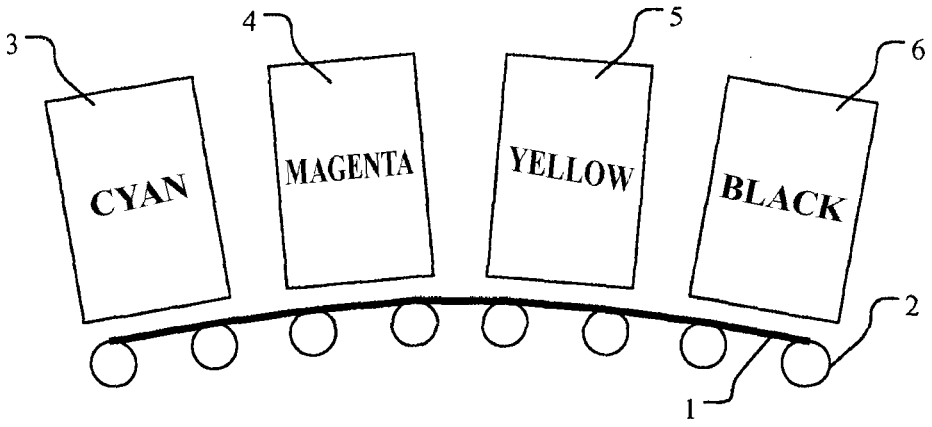
FIG. 1 is a schematic diagram of a structure of a single-side 4-color printer in the prior art.

The ink jetting digital printer usually adopts a multi-color single-side print mode. A schematic diagram of the structure of a single-side 4-color printer in the prior art is shown in FIG. 1.

In a process of single-side 4-color printing, a paper 1 is moved along a paper path formed by rollers 2. Sprayer modules of four colors cyan 3, magenta 4, yellow 5 and black 6 are arranged in the movement direction of the paper. When the paper passes through under these sprayer modules, these sprayer modules eject inks on the paper according to specified print data to print an image on the paper.

In a high speed print process, it is necessary to transmit print data at a high speed. In order to meet the requirement for the speed of print data transmission, in general, a distributed architecture is adopted.

Figure 2:
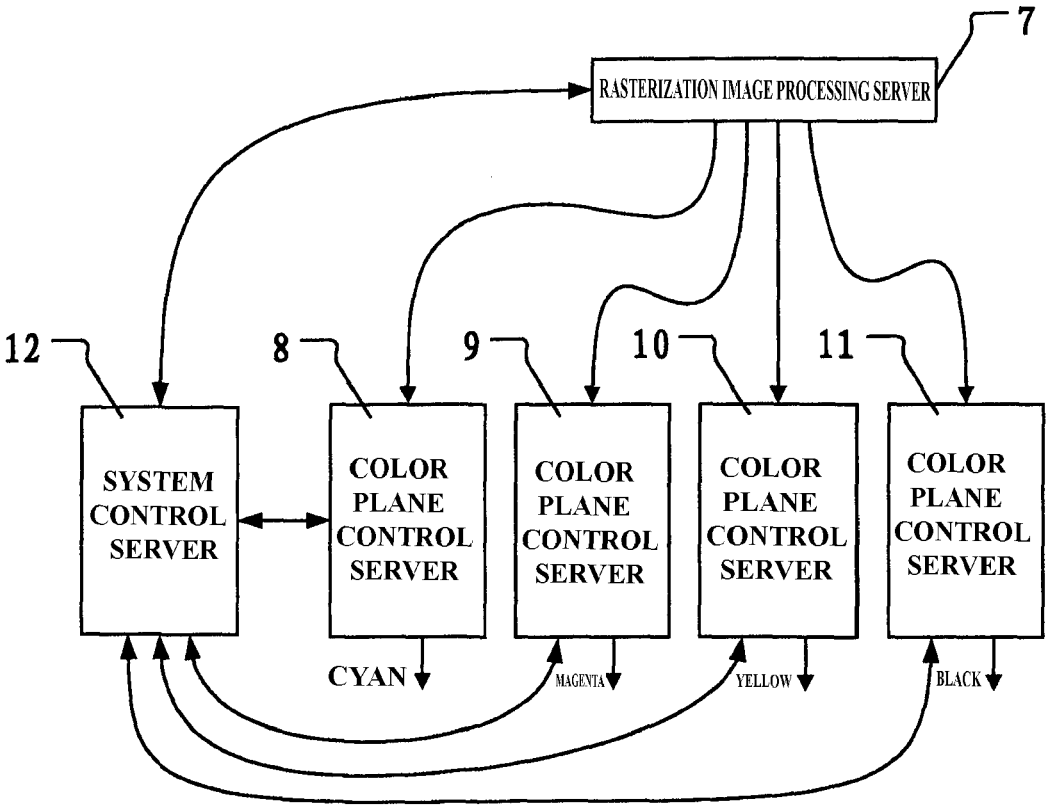
FIG. 2 is a schematic diagram of a 4-color single-side printing distributed architecture in the prior art.

FIG. 2 shows a 4-color single-side printing distributed architecture in the prior art, which illustrates a basic structure of a distributed architecture used for 4-color single-side printers in the prior art.

In this distributed architecture, the sprayer module of each color plane is provided with a color plane control server, such as the color plane control server 8, the color plane control server 9, the color plane control server 10 and the color plane control server 11 as shown in FIG. 2. The rasterization image processing server 7 performs a rasterization process on a print job to form CCDD required for every color plane and transmits the data to various color plane control server through a data transmission path. Each color plane control server processes the received data to generate complete page data and transmits the print data to corresponding sprayer modules during the print process. The system control server 12 manages all processes and provides user operation interfaces.

Figure 3:
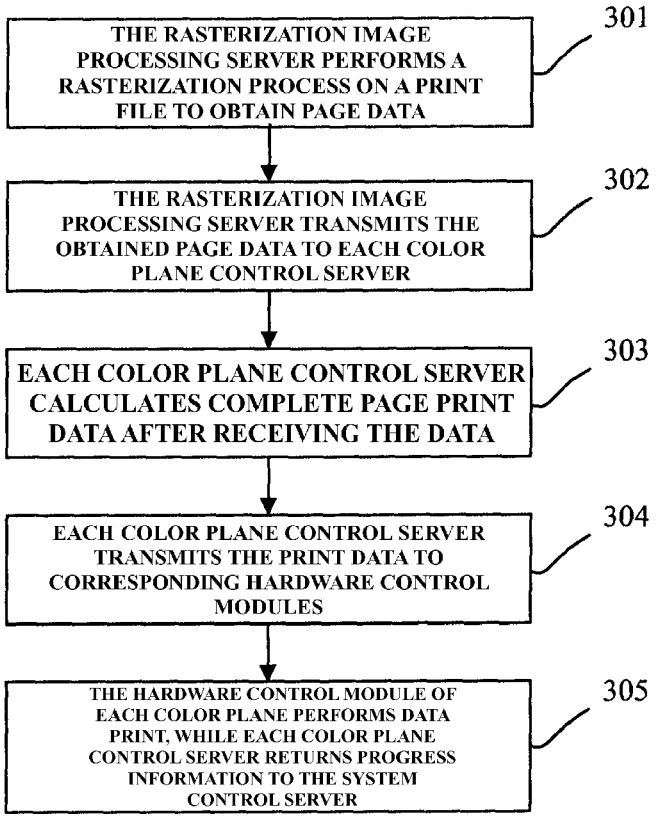
FIG. 3 is a flowchart of rasterizing image data in the single-side printing distributed architecture in the prior art.

FIG. 3 shows an operation flow, which comprises the following steps:

Step 301: the rasterization image processing server performs a rasterization process on a print file to obtain page data;

Step 302: the rasterization image processing server transmits the obtained page data to each color plane control server;

Step 303: each color plane control server calculates complete page print data after receiving the data;

Step 304: each color plane control server transmits the print data to corresponding hardware control modules;

Step 305: the hardware control module of each color plane performs data print, while each color plane control server returns progress information to the system control server.

Figure 4:
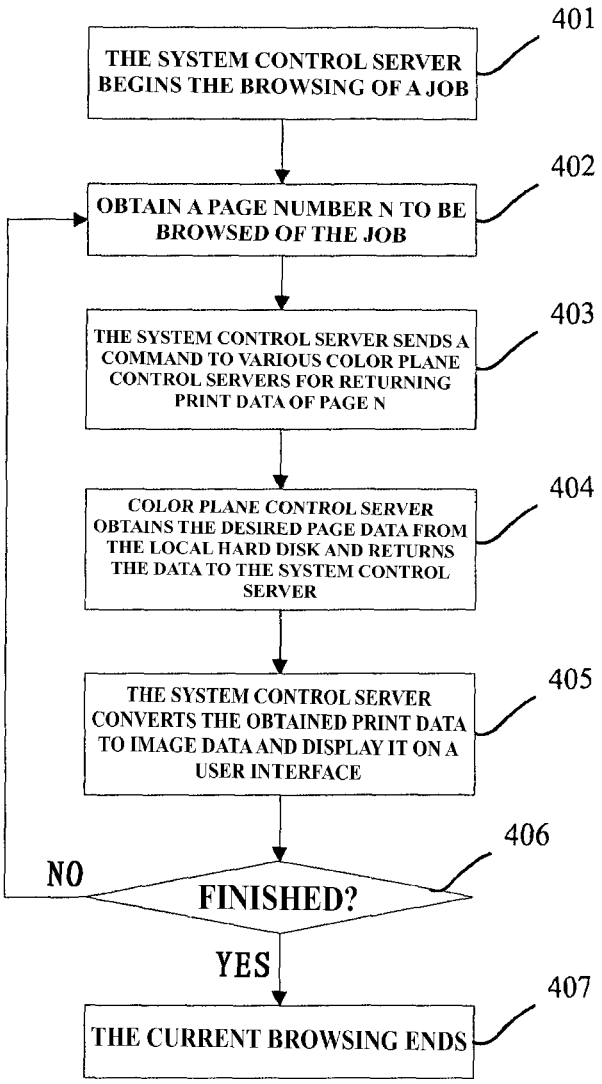
FIG. 4 is a flowchart of print browsing in the single-side printing distributed architecture in the prior art.

When a user wants to browse the print job, the operation flow is shown in FIG. 4, which comprises the following steps:

Step 401: the system control server begins the browsing of a job;

Step 402: the system control server obtains a page number n to be browsed of the job;

Step 403: the system control server sends a command to various color plane control servers for returning print data of page n;

Step 404: each color plane control server obtains print data of page n from locally stored print data and returns the data to the system control server;

Step 405: the system control server converts the obtained print data to image data and display it on a user interface;

Step 406: it is determined whether to end the process; if so, step 407 is performed; otherwise, the process returns to step 402 to continue the current browsing process;

Step 407: the browsing process ends.

In addition to multi-color single-side printing, current ink jetting digital printers also face a demand for multi-color double-side printing.

Figure 5:
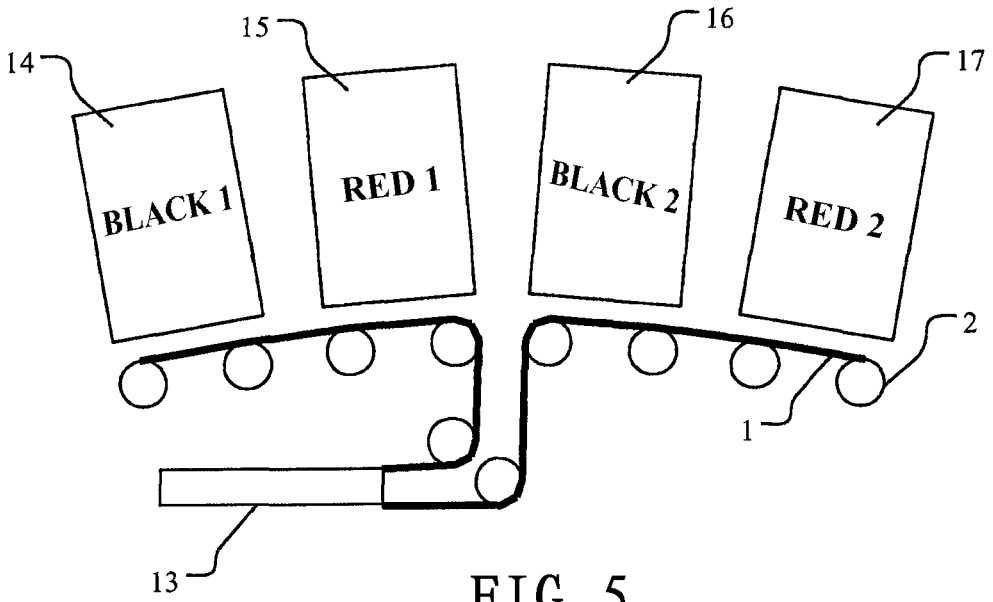
FIG. 5 is a schematic diagram of a mechanical structure of a black-red double-side printer in the prior art.

As shown in FIG. 5, a schematic diagram of a mechanical structure of a black-red double-side printer in the prior art is shown.

When a sheet of paper 1 passes through under a black sprayer 14 and a red sprayer 15 of a first HHMM with its front surface upwards, the black sprayer 14 and the red sprayer 15 of the first HHMM eject inks on the front side of the sheet to complete printing on the front side of the sheet. Then, the sheet passes through a reverse bar 13 and is reversed backside upwards. When the backside of the sheet passes through a black sprayer 16 and a red sprayer 17 of a second HHMM, the black sprayer 17 and the red sprayer 17 eject inks on the back side of the sheet according to print data to complete printing on the back side of the sheet.

In order to further increase the speed of double-side printing, an ink jetting digital printing apparatus and method supporting double-side printing is provided in embodiments of this invention, in which a distributed architecture is adopted to realize the function of multi-color double-side printing.

Figure 6:
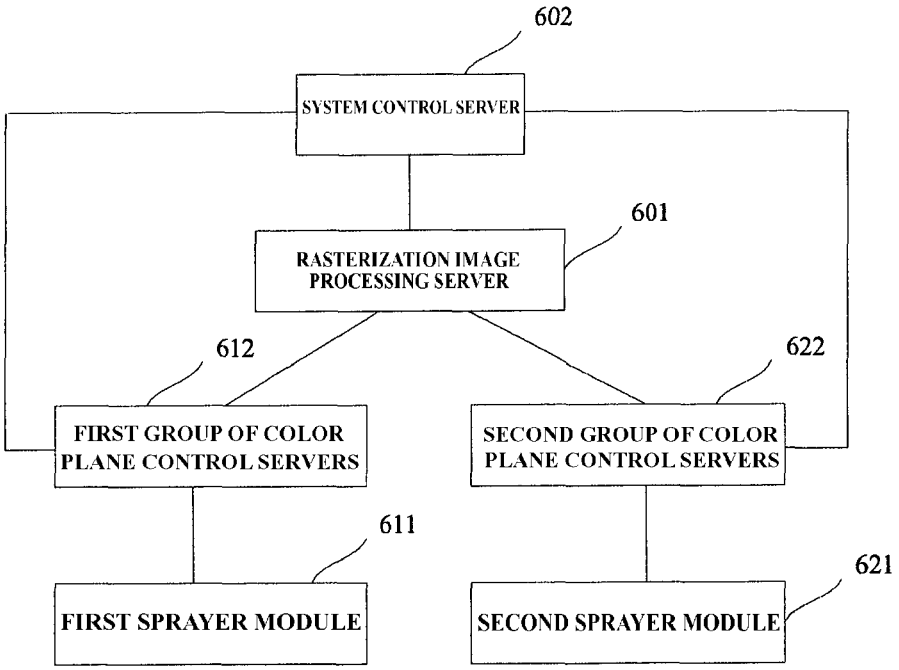
FIG. 6 is a schematic diagram of an ink jetting digital printer supporting double-side printing according to an embodiment of this invention.

FIG. 6 is a schematic diagram of an ink jetting digital printer supporting double-side printing according to an embodiment of this invention.

In this embodiment, the apparatus comprises: a first sprayer module 611 and a first group of color plane control servers 612 corresponding to the first sprayer module 611, a second sprayer module 612 and a second group of color plane control servers 622 corresponding to the second sprayer module 612, a rasterization image processing server 601 and a system control server 602. Wherein, the a first sprayer module 611 and the second sprayer module 612 comprises a group of sprayers of the same two colors or multiple colors respectively, for example, the first sprayer module 611 comprises a group of black and red sprayers, the second sprayer module 621 also comprises a group of black and red sprayers.

The first group of color plane control servers 612 comprise color plane control servers in one-to-one correspondence with sprayers of the first sprayer module 611, for example, with respect to a group of black and red sprayers, two color plane control servers are required, which correspond to the black sprayer and the red sprayer respectively. Similarly, the second group of color plane control servers 622 comprise color plane control servers in one-to-one correspondence with sprayers of the second sprayer module 621.

In order to realize fast print, color plane control servers of the first group of color plane control servers 612 are arranged in parallel with color plane control servers of the second group of color plane control servers 622.

The rasterization image processing server 601 is used to perform a rasterization process on a print file of a current print job and transmit page data obtained after the process to a corresponding group of color plane control servers.

It should be noted that the process performed on a print file by the rasterization image processing server 601 and the transmission of page data in this embodiment are different from that of a rasterization image processing server in the prior art. For example, as shown in FIG. 2, the rasterization image processing server 7 needs to simultaneously transmit page data obtained through calculation to all color plane control servers, while the rasterization image processing server 6 of this embodiment needs to determine color plane control servers of which corresponding group of color plane control servers the page data will be transmitted to according to whether a page the page data obtained after the rasterization process belongs to is an odd page or an even page on a page-by-page basis. This is, every time the color plane control server 601 transmits page data, the page data is only transmitted to some color plane control servers in the parallel arrangement, instead of all color plane control servers simultaneously, which will be further described in detail hereinafter.

The first group of color plane control servers 612 are used to generate complete front side print data according to received page data, and transmit the front side print data to a corresponding first hardware control module.

The first hardware control module is used to control operations of sprayers of the first sprayer module 611 according to the complete front side print data to achieve the printing of the front side print data.

The second group of color plane control servers 622 are used to generate complete back side print data according to received page data, and transmit the back side print data to a corresponding second hardware control module.

The second hardware control module is used to control operations of sprayers of the second sprayer module 621 according to the complete back side print data to achieve the printing of the back side print data.

Figure 7:
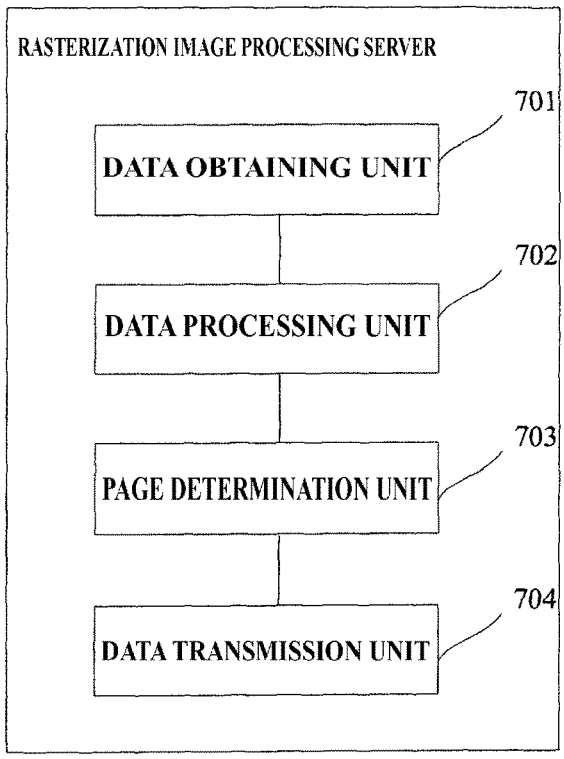
FIG. 7 is a schematic diagram of the structure of the rasterization image processing server according to the embodiment of this invention.

FIG. 7 is a schematic diagram of the structure of the rasterization image processing server according to the embodiment of this invention.

In this embodiment, the rasterization image processing server comprises:

a data obtaining unit 701 for obtaining print data of the print file;

a data processing unit 702 for performing a rasterization process on the print data to obtain page data;

a page determination unit 703 for determining whether a page the page data belongs to is an odd page or an even page;

a data transmission unit 704 for transmitting page data of an odd page determined by the page determination unit 703 to various color plane control servers of the first group of color plane control servers; transmitting page data of an even page determined by the page determination unit to various color plane control servers of the second group of color plane control servers.

It should be noted that, after receiving page data, various color plane control servers of the first group of color plane control servers 612 and the second group of color plane control servers 622 process to generate complete print data and store it locally. After receiving a print command sent from the system, the locally stored print data is transmitted to a corresponding hardware control module, and the hardware control module controls corresponding sprayers to complete the print job according to the page data.

Also, it should be noted that, as shown in FIG. 1, various color plane control servers of the first group of color plane control servers 612 and various color plane control servers of the second group of color plane control servers 622 are further used to transmit print progress information to the system control server 602.

Correspondingly, after receiving the print progress information from the various color plane control servers, the system control server 602 calculates to obtain the number of pages that have been printed of the current print job, and display the page information on a user interface.

With the ink jetting digital printer supporting double-side printing according to the embodiment of this invention, a function of print browsing may be realized.

Particularly, when it is required to browse a print job (for example, receiving a external print browsing request), the system control server 602 sends a command to the first group of color plane control servers 612 or the second group of color plane control servers 622 according to a page to be browsed is an odd page or an even page, to instruct the corresponding group of color plane control servers to return print data of the specified page. Correspondingly, the first group of color plane control servers 612 and the second group of color plane control servers 622 are further used to return print data of a specified page to the system control server 602 respectively after receiving the command sent from the system control server 602. After receiving the print data returned from the color plane control servers, the system control server 602 converts the print data to an image and displays the image on the user interface.

Figure 8:
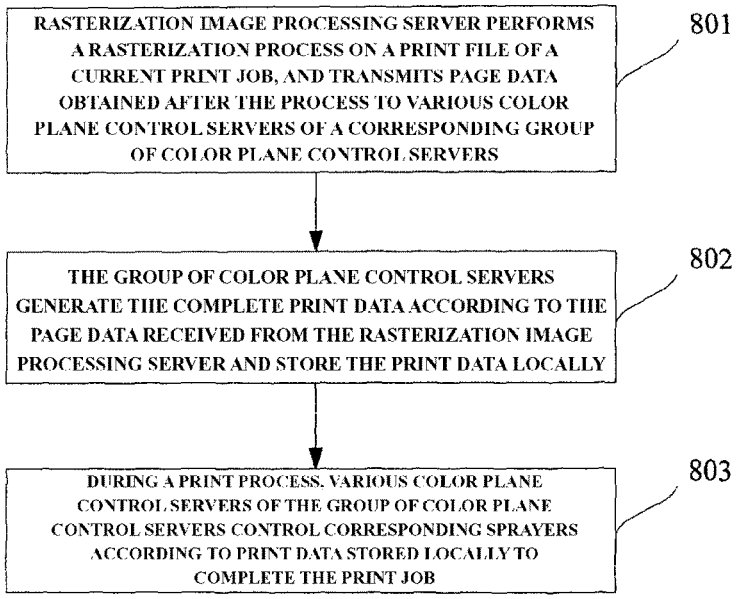
FIG. 8 is a flowchart of an ink jetting digital printing method supporting double-side printing according to an embodiment of this invention.

Correspondingly, an ink jetting digital printing method supporting double-side printing is further provided in an embodiment of this invention. FIG. 8 shows the flowchart of this method.

The method comprises the following steps.

Step 801: a rasterization image processing server performs a rasterization process on a print file of a current print job, and transmits page data obtained after the process to various color plane control servers of a corresponding group of color plane control servers;

Step 802: the group of color plane control servers generate complete print data according to the page data received from the rasterization image processing server and store the print data locally;

Step 803: during a print process, various color plane control servers of the group of color plane control servers control corresponding sprayers according to print data stored locally to complete the print job.

It should be noted that, in this embodiment, the group of color plane control servers comprise a first group of color plane control servers and a second group of color plane control servers, wherein various color plane control servers of one group of color plane control servers are arranged in parallel with color plane control servers of the other group of color plane control servers.

In the above step 801, the process performed on a print file by the rasterization image processing server and the transmission of page data are different from that of a rasterization image processing server in the prior art, and instead of transmitting page data to all color plane control servers in the parallel arrangement, the obtained page data must be transmitted to color plane control servers of a corresponding group of color plane control servers determined according to whether a page the print data belongs to is an odd page or an even page on a page-by-page basis. Particularly, the rasterization image processing server obtains print data of the print file; determines whether a page the print data currently obtained belongs to is an odd page or an even page; if the page the print data belongs to is an odd page, a rasterization process is performed on the print data and page data generated after the process is transmitted to various color plane control servers of the first group of color plane control servers; if the page the print data belongs to is an even page, a rasterization process is performed on the print data and page data generated after the process is transmitted to various color plane control servers of the second group of color plane control servers.

Therefore, through processing the print file and transmitting page data by the rasterization image processing server in the above step 801, multi-color double-side printing may be realized with a distributed architecture and print speed may be increased. Further, on the basis of the distributed architecture for multi-color one-side printing, the function of multi-color double-side printing is supported at a cost of minor modification.

It should be noted that, an ink jetting digital printing method supporting double-side printing provided in another embodiment of this invention further comprises the following steps:

during a print process, transmitting print progress information from various color plane control servers of the group of color plane control servers to the system control server;

after receiving the print progress information of the various color plane control servers, calculating by the system control server a number of pages that have been printed of the current print job, and displaying page information on the user interface.

With the ink jetting digital printing method supporting double-side printing of this invention, a browsing process may be as follows.

(1) when it is required to browsing a print job, sending a command from the system control server to the first group of color plane control servers or the second group of color plane control servers according to whether a page to be browsed is an odd page or an even page, to instruct the group of color plane control servers to return print data of the specified page;

(2) after receiving the command sent from the system control server, returning print data of the specified page by the first group of color plane control servers or the second group of color plane control servers;

(3) after receiving the print data returned from the group of color plane control servers, converting the print data to an image by the system control server and displaying the image on the user interface.

Below, the ink jetting digital printing apparatus and method supporting double-side printing of this invention will be further described with 2-color double-side printing as an example.

Figure 9:
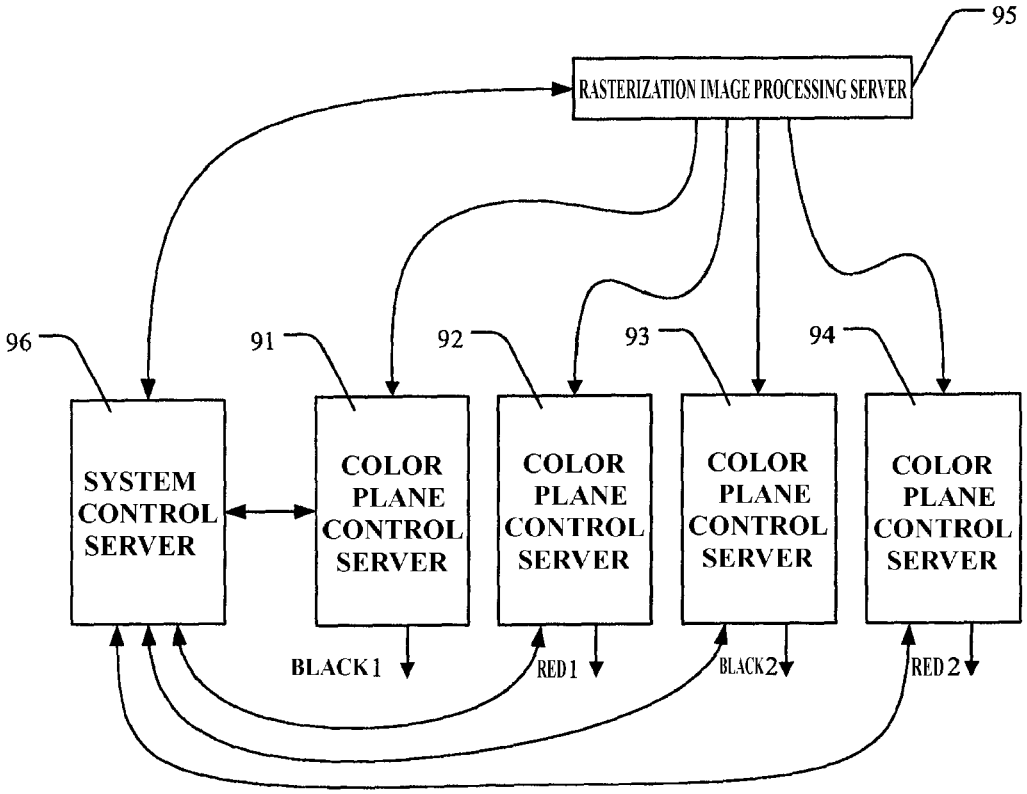
FIG. 9 is a schematic diagram of a distributed architecture for 2-color double-side printing according to an embodiment of this invention.

FIG. 9 is a schematic diagram of a distributed architecture for 2-color double-side printing according to an embodiment of this invention.

Wherein, the color plane control server 91 and the color plane control server 92 form a first group of color plane control servers, and provide print data to a black sprayer 14 and a red sprayer 15 (as shown in FIG. 5) of a first sprayer module used for font-side printing; the color plane control server 93 and the color plane control server 94 form a second group of color plane control servers, and provide print data to a black sprayer 16 and a red sprayer 17 (as shown in FIG. 5) of a second sprayer module used for back-side printing.

In a print job, two adjacent pages are printed on the front side and the back side of one sheet of paper during a print process. Therefore, the flow of data distribution in the image rasterization process is different from that in the prior art, which will be described in detail below.

Figure 10:
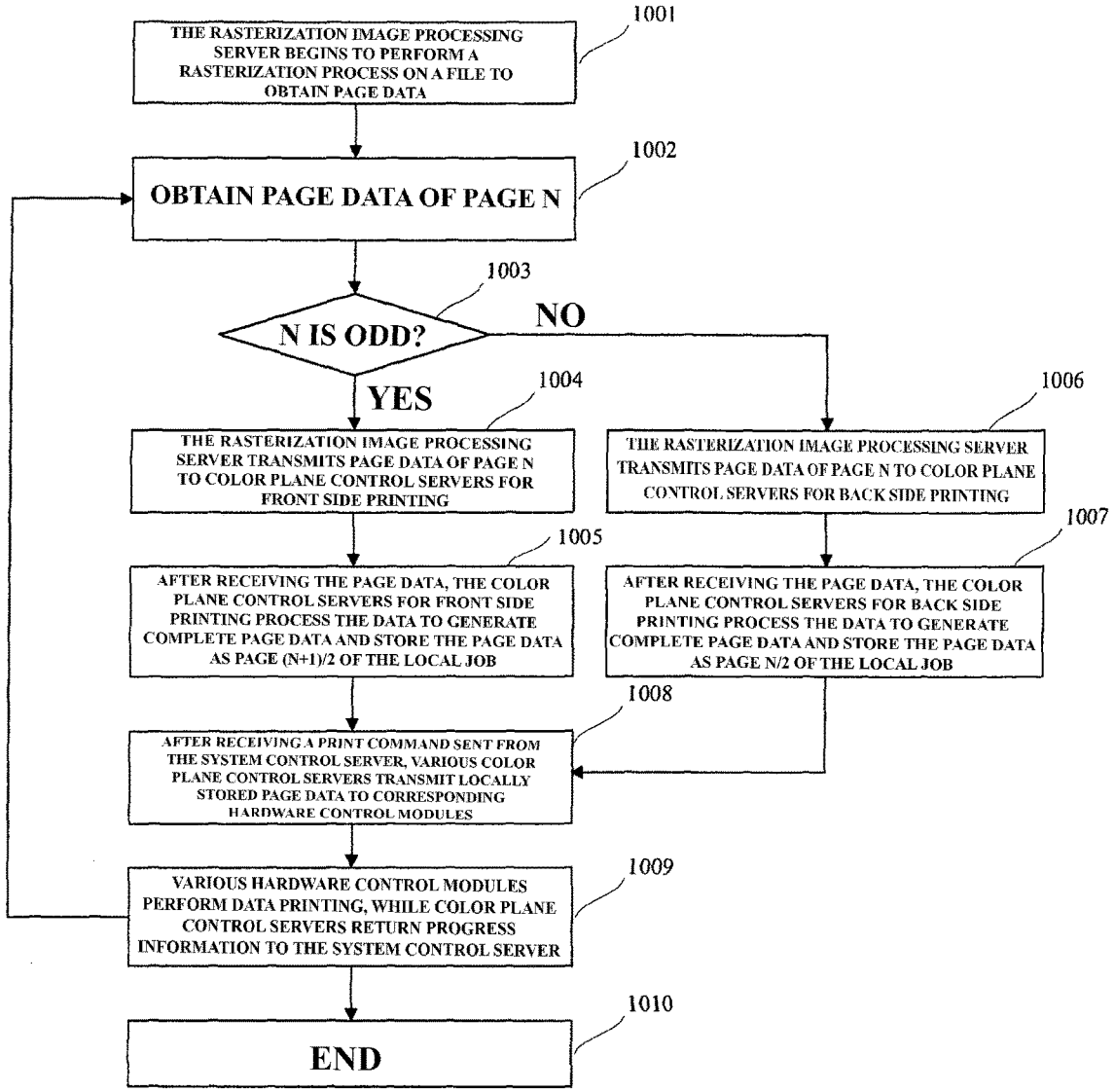
FIG. 10 is a flowchart of data processing in the distributed architecture for 2-color double-side printing shown in FIG. 9.

FIG. 10 is a flowchart of data processing in the distributed architecture for 2-color double-side printing shown in FIG. 9, comprising the following steps:

Step 1001: the rasterization image processing server begins to perform a rasterization process on a file to obtain page data;

Step 1002: obtain page data of page n;

Step 1003: determine whether n is an odd or an even number; if it is an odd number, step 1004 is executed; if it is an even number, step 1006 is executed;

Step 1004: transmit page data of page n to color plane control servers for front side printing, i.e., color plane control servers 91 and 92 in FIG. 9;

Step 1005: after receiving the page data, the color plane control servers for front side printing process the data to generate complete page data and store the page data as page (n+1)/2 of the local job; then step 1008 is executed;

Step 1006: transmit page data of page n to color plane control servers for back side printing, i.e., color plane control servers 93 and 94 in FIG. 9;

Step 1007: after receiving the page data, the color plane control servers for back side printing process the data to generate complete page data and store the page data as page n/2 of the local job;

Step 1008: after receiving a print command sent from the system control server, various color plane control servers transmit locally stored page data to corresponding hardware control modules;

Step 1009: various hardware control modules perform data printing, while color plane control servers return progress information to the system control server;

Step 1010: the current job ends after the print process is completed.

It should be noted that, during a print process, various color plane control servers transmit data to corresponding sprayer modules according to the normal print flow and return progress information to the system control server 96. In the print process of a job, if two color plane control servers 91, 92 for front-side printing have completed the printing of pages n1 and n2 respectively, a smaller value of n1 and n2 is the number of pages that have been printed, i.e., M=min(n1, n2). If two color plane control servers 93, 94 for back-side printing have completed the printing of pages n3 and n4 respectively, a smaller value of n3 and n4 is the number of pages that have been printed, i.e., N=min(n3, n4). The total number of pages that have been printed in the job is M+N. During the print process, after receiving print progress information returned from various color plane control servers, the system control server 96 obtains a number of pages that have been printed in the job through calculation and displays it on the user interface.

Figure 11:
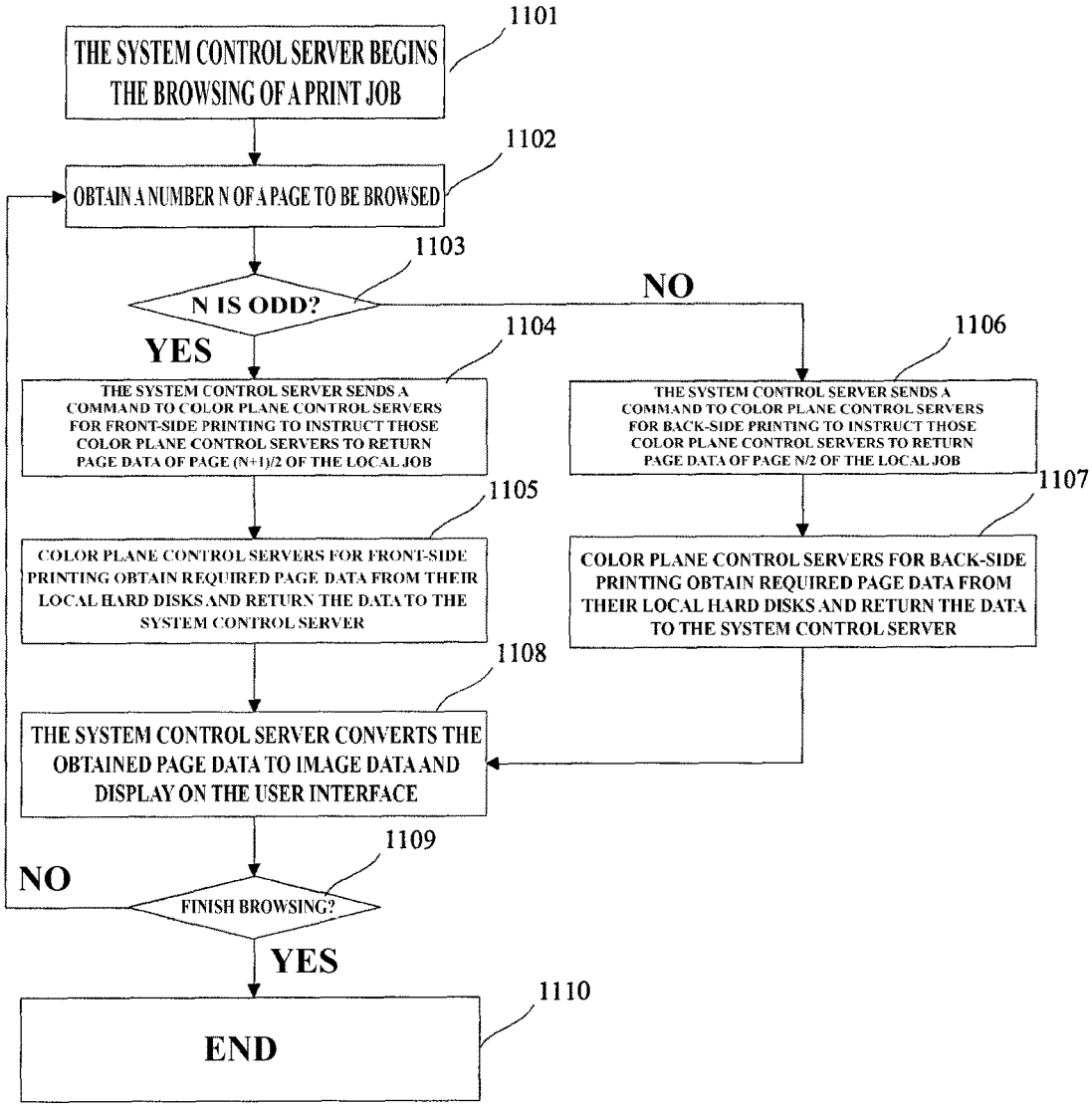
FIG. 11 is a flowchart of print browsing in the distributed architecture for 2-color double-side printing shown in FIG. 9.

FIG. 11 is a flowchart of print browsing in the distributed architecture for 2-color double-side printing shown in FIG. 9, and comprises the following steps:

Step 1101: the system control server begins the browsing of a print job;

Step 1102: obtain a number n of a page to be browsed;

Step 1103: determine whether n is odd, step 1104 is executed; otherwise, step 1106 is executed;

Step 1104: the system control server sends a command to color plane control servers for front-side printing to instruct those color plane control servers to return page data of page (n+1)/2 of the local job;

Step 1105: color plane control servers for front-side printing obtain required page data from their local hard disks and return the data to the system control server; then step 1108 is executed;

Step 1106: the system control server sends a command to color plane control servers for back-side printing to instruct those color plane control servers to return page data of page n/2 of the local job;

Step 1107: color plane control servers for back-side printing obtain required page data from their local hard disks and return the data to the system control server;

Step 1108: the system control server converts the obtained page data to image data and display on the user interface;

Step 1109: the system control server determines whether a command for finishing the browsing process has been received; if so, step 1110 is executed; otherwise, the process returns to step 1102; Step 1110: the current browsing process ends.

It should be noted that the flow of data process and transmission is only described above with a distributed architecture for 2-color double-side printing as an example. In practical applications, each sprayer module may comprise sprayers of various colors, such as cyan, magenta, yellow and black. In this situation, the flow of data process and transmission for realizing multi-color double-side printing is similar to that described above, and will not be repeated herein.

This disclosure further provides one or more computer readable medium having stored thereon computer-executable instructions that when executed by a computer perform an ink jetting digital printing method supporting double-side printing, the method comprising the following steps: A. performing, by a rasterization image processing server, a rasterization process on a print file of a current print job, and transmitting page data obtained after the process to various color plane control servers of a corresponding group of color plane control servers; B. generating, by the group of color plane control servers, complete print data according to the page data received from the rasterization image processing server and storing the print data locally; C. during a print process, controlling corresponding sprayers by various color plane control servers of the group of color plane control servers according to print data stored locally to complete the print job.

This disclosure also provides a computer with one or more computer readable medium having stored thereon computer-executable instructions that when executed by the computer perform various steps of the ink jetting digital printing method supporting double-side printing described above.

Exemplary Operation Environment

The computer or computing device as described herein comprises hardware, including one or more processors or processing units, system memory and some types of computer readable media. By way of example and not limitation, computer readable media comprise computer storage media and communication media. Computer storage media comprises volatile and non-volatile, removable and non-removable media implemented in any method or technology for storage of information such as computer readable instructions, data structures, program modules or other data. Communication media typically embody computer readable instructions, data structures, program modules, or other data in a modulated data signal such as a carrier wave or other transport mechanism and include any information delivery media. Combinations of any of the above are also included within the scope of computer readable media.

The computer may operate in a networked environment using logical connections to one or more remote computers, such as a remote computer. Although a description has been given in combination with an exemplary computing system environment, various embodiments of this invention are applicable to other general or dedicated computing system environments or configurations. Although described in connection with an exemplary computing system environment, embodiments of the invention are operational with numerous other general purpose or special purpose computing system environments or configurations. The computing system environment is not intended to suggest any limitation as to the scope of use or functionality of any aspect of the invention. Moreover, the computing system environment should not be interpreted as having any dependency or requirement relating to any one or combination of components illustrated in the exemplary operating environment. Examples of well known computing systems, environments, and configurations that may be suitable for use with aspects of the invention include, but are not limited to, personal computers, server computers, hand-held or laptop devices, multiprocessor systems, microprocessor-based systems, set top boxes, programmable consumer electronics, mobile telephones, network PCs, minicomputers, mainframe computers, distributed computing environments that include any of the above systems or devices, and the like.

Embodiments of the invention may be described in the general context of computer-executable instructions, such as program modules, executed by one or more computers or other devices. The computer-executable instructions may be organized into one or more computer-executable components or modules. Generally, program modules include, but are not limited to, routines, programs, objects, components, and data structures that perform particular tasks or implement particular abstract data types. Aspects of the invention may be implemented with any number and organization of such components or modules. For example, aspects of the invention are not limited to the specific computer-executable instructions or the specific components or modules illustrated in the figures and described herein. Other embodiments of the invention may include different computer-executable instructions or components having more or less functionality than illustrated and described herein. Aspects of the invention may also be practiced in distributed computing environments where tasks are performed by remote processing devices that are linked through a communications network. In a distributed computing environment, program modules may be located in both local and remote computer storage media including memory storage devices.

The embodiments in the present specification are described in a progressive manner. For the same or similar parts of various embodiments, reference may be made among the embodiments. Each embodiment focuses on the differences from other embodiments. The apparatus embodiments described above are merely illustrative, in which elements that are described as separated parts may be or may not be physically separated from each other, and those ones shown individually may be or may not be physical elements, which may be positioned at one position or may be distributed over multiple network units. Some or all modules thereof may be selected as required to realize the object of the embodiments of this invention as can be understood and implemented by those skilled in the art without any creative effort.

The component embodiments of the present invention may be implemented by hardware, or by the software run on one or more processors, or by the combination thereof.

The embodiments of the present invention have been described above in detail, and specific examples are used herein to illustrate the principle and embodiments of the present invention, which are only used to help understand the method and apparatus of the present invention; meanwhile, as for the one skilled in the art, changes can be made to the embodiments and application scope in accordance with the concept of the present invention. In view of the foregoing, the contents of the specification should not be interpreted as limitations to the scope of the present invention which should be referred to the appended claims.

What is claimed is:

1. An ink jetting digital printing apparatus supporting double-side printing, characterized in comprising: a first sprayer module and a corresponding first group of color plane control servers, a second sprayer module and a corresponding second group of color plane control servers, a rasterization image processing server, and a system control server; wherein the first sprayer module and the second sprayer module comprise a group of sprayers of the same two or more colors respectively; the first group of color plane control servers comprise color plane control servers in one-to-one correspondence with sprayers in the first sprayer module; the second group of color plane control servers comprise color plane control servers in one-to-one correspondence with sprayers in the second sprayer module; the color plane control servers in the first group of color plane control servers are arranged in parallel with the color plane control servers in the second group of color plane control servers;

the rasterization image processing server is used to perform a rasterization process on a print file of a current print job, and transmit page data obtained after the process to a corresponding group of color plane control servers;

the first group of color plane control servers are used to generate complete font-side print data according to the page data received from the rasterization image processing server, and transmit the font-side print data to a corresponding first hardware control module;

the first hardware control module is used to control the first sprayer module according to the complete font-side print data to complete the printing of the font-side print data;

the second group of color plane control servers are used to generate complete back-side print data according to the page data received from the rasterization image processing server, and transmit the back-side print data to a corresponding second hardware control module;

the second hardware control module is used to control the second sprayer module according to the complete back-side print data to complete the printing of the back-side print data;

various color plane control servers of the first group of color plane control servers and various color plane control servers of the second group of color plane control servers are further used to transmit print progress information to a system control server; and the system control server is used to, according to the print progress information of the various color plane control servers, calculate a number of pages that have been printed in the current print iob and display the page number information on a user interface.

2. The apparatus according to claim 1, characterized in that the rasterization image processing server comprises:

a data obtaining unit for obtaining print data of the print file;

a data processing unit for performing a rasterization process on the print data to obtain page data;

a page determination unit for determining whether a page the page data belongs to is a odd page or an even page; and a data transmission unit for transmitting page data of an odd page determined by the page determination unit to various color plane control servers of the first group of color plane control servers, and transmitting page data of an even page determined by the page determination unit to various color plane control servers of the second group of color plane control servers.

3. The apparatus according to claim 1, characterized in that the system control server is further used to, when it is required to browse a print job, according to whether a page to be browsed is an odd or even page, send a command to the first group of color plane control servers or the second group of color plane control servers to instruct the group of color plane control servers to return print data of the specified page;

the first group of color plane control servers and the second group of color plane control servers are further used to, after receiving the command sent from the system control server, return print data of the specified page to the system control server respectively; and the system control server is further used to, after receiving the print data returned from the group of color plane control servers, convert the print data to an image and display the image on the user interface.

4. An ink jetting digital printing method supporting double-side printing, characterized in comprising the following steps:

A. performing, by a rasterization image processing server, a rasterization process on a print file of a current print job, and transmitting page data obtained after the process to various color plane control servers of a corresponding group of color plane control servers;

B. generating, by the group of color plane control servers, complete print data according to the page data received from the rasterization image processing server and storing the print data locally;

C. during a print process, controlling corresponding sprayers by various color plane control servers of the group of color plane control servers according to print data stored locally to complete the print job; and transmitting, by various color plane control servers of the group of color plane control servers, print progress information to a system control server during a print process;

according to the print progress information received from the various color plane control servers, calculating by the system control server a number of pages that have been printed in the current print iob and displaying page number information on a user interface;

wherein the group of color plane control servers comprise a first group of color plane control servers and a second group of color plane control servers, various color plane control servers of one group of color plane control servers being arranged in parallel with color plane control servers of the other group of color plane control servers.

5. The method according to claim 4, characterized in that step A comprises:

performing a rasterization process on the print file of the current print job by the rasterization image processing server to obtain the page data;

determining whether the page data belongs to an odd page or an even page;

in the case of an odd page, transmitting the page data to various color plane control servers of the first group of color plane control servers; and in the case of an even page, transmitting the page data to various color plane control servers of the second group of color plane control servers.

6. The method according to claim 4, characterized in that the method further comprises:

when it is required to browse the print job, according to whether a page to be browsed is an odd or even page, sending by the system control server a command to the first group of color plane control servers or the second group of color plane control servers to instruct the group of color plane control servers to return print data of the specified page;

after receiving the command sent from the system control server, returning print data of the specified page to the system control server by the first group of color plane control servers and the second group of color plane control servers respectively; and after receiving the print data returned from the group of color plane control servers, converting the print data to an image by the system control server and displaying the image on the user interface.

7. The method according to claim 6, characterized in that, according to whether a page to be browsed is an odd or even page, sending by the system control server a command to the first group of color plane control servers or the second group of color plane control servers to instruct the group of color plane control servers to return print data of the specified page comprises:

if page n to be browsed is an odd page, sending by the system control server a command to the first group of color plane control servers to instruct the first group of color plane control servers to return print data of the page (n+1)/2; and if page n to be browsed is an even page, sending by the system control server a command to the second group of color plane control servers to instruct the second group of color plane control servers to return print data of the page n/2.

* * * * *